United States Patent [19]

Taylor

[11] 4,359,221

[45] Nov. 16, 1982

[54] METHOD FOR ASSISTING BOWLERS IN MAINTAINING AN OPTIMUM FOLLOW-THROUGH ANGLE

[76] Inventor: Wilson G. Taylor, P.O. Box 146, San Gabriel, Calif. 91776

[21] Appl. No.: 159,824

[22] Filed: Jun. 16, 1980

[51] Int. Cl.[3] ..... A63B 69/00

[52] U.S. Cl. ..... 273/54 B; 273/189 R

[58] Field of Search ..... 273/54 B, 189 R

[56] References Cited

U.S. PATENT DOCUMENTS

| | | | |
|---|---|---|---|
| 1,279,924 | 9/1918 | Smith | 273/189 R |
| 2,980,426 | 4/1961 | Johnson | 273/189 R X |
| 3,069,169 | 12/1962 | Topping | 273/189 R |
| 3,101,196 | 8/1963 | Ferrara | 273/54 B |
| 3,595,583 | 7/1971 | Oppenheimer | 273/54 B |

*Primary Examiner*—Anton O. Oechsle

*Attorney, Agent, or Firm*—Fulwider, Patton, Rieber, Lee & Utecht

[57] ABSTRACT

A strap, preferably elastic, extends between the middle of a bowler's back and the upper portion of the bowler's free arm. It inhibits rearward movement of the bowling shoulder and/or rotational movement of the shoulders that could result in a follow-through angle of less than ninety degrees. The strap, which preferably is at least partially elastic, can extend between a body belt that encircles the bowler's torso at the waist and an arm belt that encircles the free arm in the biceps region.

2 Claims, 7 Drawing Figures

METHOD FOR ASSISTING BOWLERS IN MAINTAINING AN OPTIMUM FOLLOW-THROUGH ANGLE

FIELD OF THE INVENTION

The present invention relates to the sport of bowling, and, more particularly, to a method and device that aids a bowler in maintaining the proper position of the bowling.

BACKGROUND OF THE INVENTION

It has been demonstrated that the proper upper body position for a bowler requires that the shoulders remain "square". In other words, an axis passing through the shoulders, perpendicular to the direction in which the upper body is facing, should be perpendicular to the plane in which the bowling arm swings the ball and the direction in which the ball is thrown. The ball direction, as referred to here, is the direction of the ball as it leaves the bowler's hand, not the direction it may assume later, as it proceeds down the alley under the influence of its imbalance or its rotational, frictional curving forces.

Once the ball has been thrown and the arm has been fully extended in the direction of the initial ball movement, the arm should form an angle of ninety degrees with the shoulder axis. This angle is referred to as the follow-through angle and provides a quantitive measure of the squareness of the shoulder position and a substantial measure of the efficacy of the flight of the ball in rotational motion.

Relatively small deviations from the optimum 90 degree follow-through angle can have a pronounced effect on the performance of the ball. When the angle is reduced, due to a trailing bowling shoulder, the bowler cannot impart lifting force to the ball and/or the bowler may release the ball in a slightly wrong direction and miss his lane target. A reduction of this angle to 85 degrees will generally alter the angular momentum and reduce precession sufficiently to cause the ten pin to be left standing by the weaker hitting ball. An angle of 80 or 75 degrees usually reduces the hitting power of the ball enough to result in an 8–10 or 5–7 split (for a right-handed bowler).

The principal reason for the criticality of the follow-through angle is that the finger force lifting the ball is imparted at a different angle to the ball due to some error in the bowler's approach which is evidenced by the follow-through deviation, even though the finger lifting force itself remains substantially the same. A change in the angle of the finger lifting force causes the rotational axis of the ball to be shifted and alters the angular momemtum and the resulting precession. The phenomenon of precession as applied to the flight of a bowling ball is explained in the inventor's allowed U.S. patent application Ser. No. 062,359, now U.S. Pat. No. 4,233,846, entitled METHOD AND APPARATUS FOR MEASURING THE IMBALANCE OF A BOWLING BALL. The subject of the follow-through angle and its importance is discussed in greater detail in the inventor's book *Balance*, published in 1978 by B. T. Bowling Products of Los Angeles, Calif.

Many bowlers experience considerable difficulty in maintaining the more effective ninety degree follow-through angle. A common cause of the problem is that the bowler brings the shoulder of his bowling arm back with the ball at an early stage of the approach, thus rotating the shoulder axis relative to the lower body and setting up a much less effective shoulder axix/arm swing relationship. As the ball moves forward, the shoulder arm swing relationship is not fully corrected by moving the bowling shoulder forward to its original position, or it is not corrected at all. Often, the bowler finds it very difficult to correct this important error.

The primary objective of the present invention is to provide a device and method that will assist a bowler in maintaining a proper shoulder axis/arm swing relationship to effect a 90 degree follow-through angle.

SUMMARY OF THE INVENTION

The present invention resides in a training aid for bowlers and in a method for using such an aid whereby undesirable rearward bowling shoulder movement that would result in a follow-through angle of less than ninety degrees is inhibited. It employs a strap that extends from the middle of the bowler's back to the upper portion of the free arm. Preferably, the strap is at least partially elastic to avoid any sudden pull on the arm, and its unstretched length is adjustable.

According to one aspect of the invention, the training aid includes a body belt that encircles the bowler's torso, preferably at the waist, and an arm belt that encircles the free arm near the shoulder. The elastic strap extends between the two belts.

Other features and advantages of the present invention will become apparent from the following description, taken in conjunction with the accompanying drawings which illustrate, by way of example, the principles of the invention.

BRIEF DESCRIPTION OF THE DRAWINGS

FIG. 7 is a still another schematic illustration showing the bowler at the end of the follow-through.

DESCRIPTION OF THE PREFERRED EMBODIMENT

Figure 1:
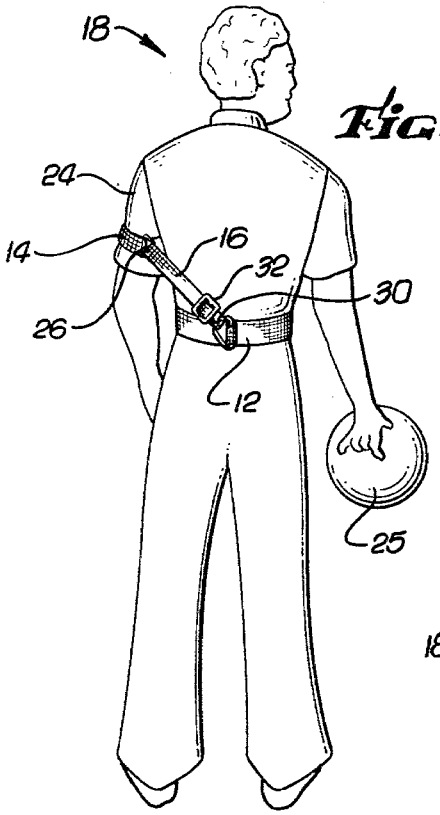
FIG. 1 is a pictorial illustration of a bowler wearing a training aid in accordance with the present invention.
Figure 2:
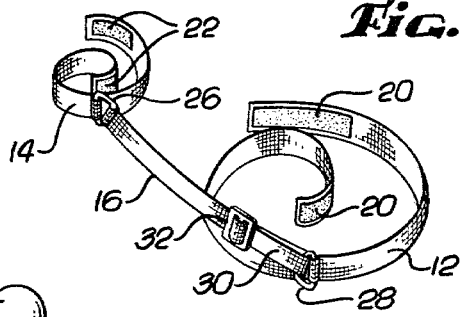
FIG. 2 is an enlarged, perspective view in which the training aid of FIG. 1 is shown separately.
Figure 3:
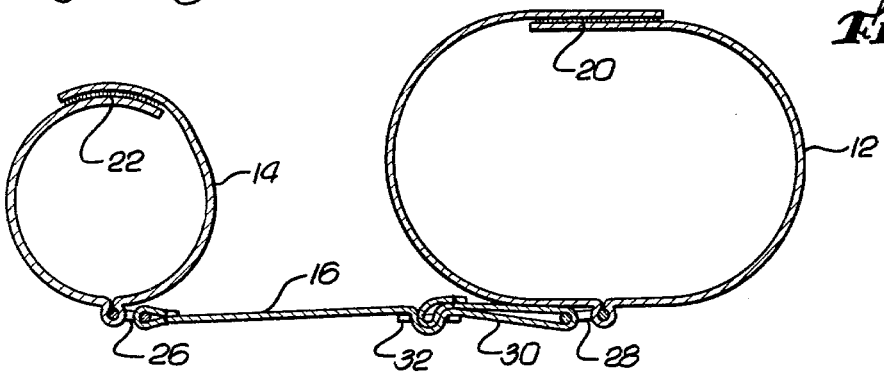
FIG. 3 is a plan view of the training aid.

A training device 10 for bowlers, constructed in accordance with the present invention and shown in FIGS. 1–3 of the accompanying drawings, includes, as its primary components, a body belt 12, an arm belt 14, and a restraining strap 16 connecting the two belts. In this exemplary embodiment, the body belt 12 is made of a relatively tough, stiff woven fabric and is wrapped around the torso of a bowler 18 at the waist, as shown in FIG. 1. At the front, the body belt 12 is closed by a Velcro-type fastener 20 and fits snugly. It will, of course, be understood that the body belt 12 can be made of another suitable material, such as leather, and can be closed by a buckle or other such fastener.

The arm belt 14 is similar in construction to the body belt 12, but is shorter and somewhat narrower. In this embodiment, it also is closed by a Velcro-type fastener 22. It is worn on the upper arm 24 of the bowler 18 around the biceps, this being the bowler's free arm that is not used to throw the ball 25.

The restraining strap 16 is secured at one end to the arm belt 14 by a triangular link 26 around which the belt and the strap are each looped and sewn at the back of the arm 24. The opposite end of the strap 16 is secured to the body belt 12 by a second triangular link 28 around which the body belt is looped and sewn at the middle of the back at the waistline. Securement of the strap 16 to the link 28 is by an elongated adjustable loop 30 formed in the end of the strap. The length of the strap 16 between the two belts 12 and 14 is controlled by the a cinch buckle 32 used to close the loop. Preferably the strap 16 is elastic.

Figure 6:
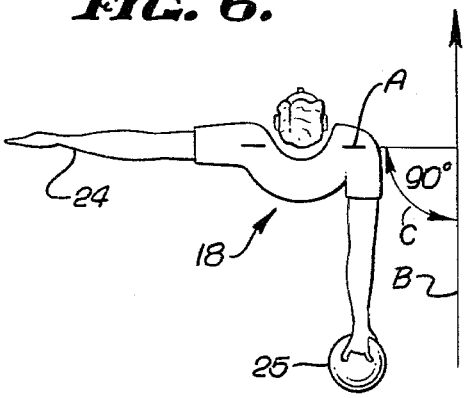
FIG. 6 is another schematic illustration, looking downwardly at a bowler during the approach.
Figure 7:
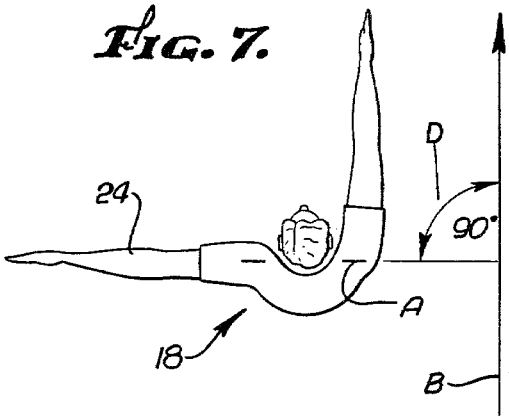

The function of the training aid 10 is best understood with reference to FIGS. 6 and 7 which schematically illustrate the bowler 18 in his next-to-last step and at the completion of the follow-through, respectively. At all times, the shoulder axis "A" remains perpendicular to the direction "B" in which the ball is thrown. In other words, the follow-through angle is 90 degrees. It is desired to prevent the bowler 18 from allowing his bowling shoulder 34 to move rearwardly, thereby increasing the backswing angle "C" beyond 90 degrees and subsequently causing the follow-through angle "D" to become less than 90 degrees.

Figure 4:
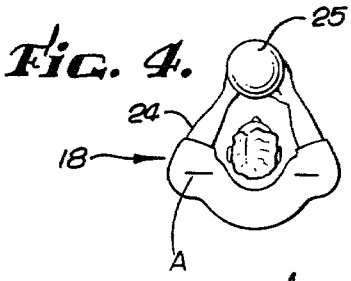
FIG. 4 is a schematic illustration, looking downwardly at a bowler with the ball positioned directly in front of his body.
Figure 5:
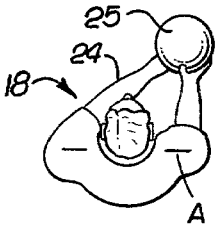
FIG. 5 is a similar schematic illustration with the ball in front of the bowler in the push-away position in preparation to the beginning of the approach.

The length of the restraining strap 16 is adjusted so that it is fully extended but not stretched when the bowler 18 stands with his ball 25 held squarely in front of his body (FIG. 4). When the bowler 18 shifts his ball 25 to the push away position (FIG. 5) and first establishes the optimum 90 degree shoulder/arm swing relationship, the strap 16 is stretched and the bowler's free arm 24 starts to pull on the strap. After the bowler 18 completes the push-away with both hands, which stretches the strap 16 even more, the stretching force of the elastic seeks to pull the free arm 24 back into proper alignment with the shoulders axis A. This should occur at some time before the ball 25 moves into the backswing (at which time the force of the ball tends to pull the bowling shoulder back and disrupt the 90 degree should/arm swing orientation if the free arm 24 is allowed to remain forward of alignment with the shoulders axis A). The constant tug of the strap 16 tends to restrain this rearward bowling shoulder movement and instantly makes the bowler 18 aware of his mistake.

It is preferable to use a strap 16 that is elastic so that the device 10 will tug with a force proportional to the degree of the bowler's misalignment of the shoulders axis A. The elasticity of the strap 16 also reduces any tendency of the body belt 12 to rotate about the waist.

The invention provides a simple but highly effective device that aids a bowler in overcoming the natural and common tendency to depart from the optimum shoulder axis/arm swing relationship and reduce the follow-through angle through rearward movement of the bowling shoulder, i.e., shoulder rotation. It will be appreciated from the foregoing that, while a particular form of the invention has been illustrated and described, various modifications can be made without departing from the spirit and scope of the claims.

I claim:

1. A method for assisting a bowler in maintaining an optimum shoulder axis/arm swing relationship comprising attaching a restraining strap to the bowler so that it extends from a location on the back of the bowler's torso to the upper portion of the bowler's free arm at the bicep, the length of the strap being such that it resists shoulder axis movement away from the optimum position.

2. A method for assisting a bowler in maintaining an optimum shoulder axis/arm swing relationship and achieving the desired follow-through angle comprising:

securing a body belt around the torso of the bowler at the waist;

securing an arm belt around the bicep of the upper portion of the bowler's free arm by which the ball is not carried;

securing one end of an elastic restraining strap to said body belt at the center of the bowler's back, securing the other end of the strap to said arm belt; and adjusting the length of said strap to resist undesired rotational shoulder axis movement.

* * * * *